United States Patent [19]

Willaschek

[11] Patent Number: 4,592,539

[45] Date of Patent: Jun. 3, 1986

[54] DEVICE FOR ARRESTING A STEEL MAKING CONVERTER

[75] Inventor: Horst Willaschek, Oberhausen, Fed. Rep. of Germany

[73] Assignee: M.A.N. Maschinenfabrik Augsburg-Nürnberg, Fed. Rep. of Germany

[21] Appl. No.: 690,152

[22] Filed: Jan. 10, 1985

[30] Foreign Application Priority Data

Jan. 12, 1984 [DE] Fed. Rep. of Germany ..... 3400892

[51] Int. Cl.[4] ..... C21C 5/50

[52] U.S. Cl. ..... 266/246; 266/287

[58] Field of Search ..... 266/243, 244, 245, 246, 266/247, 287

[56] References Cited

U.S. PATENT DOCUMENTS 3,995,841 12/1976 Riegler et al. ..... 266/246

FOREIGN PATENT DOCUMENTS 3024548 3/1982 Fed. Rep. of Germany ..... 266/245

*Primary Examiner*—L. Dewayne Rutledge
*Assistant Examiner*—Robert L. McDowell
*Attorney, Agent, or Firm*—McGlew and Tuttle

[57] ABSTRACT

An arresting device for preventing a steel making converter which is carried by a trunnion for moving itself during the blowing operation includes a rotatable bearing support for the trunnion or trunnion parts which extend from each side of the bessimer converter which carries a braking disc which is secured to at least one of the trunnion parts. The disc is advantageously mounted so as to be perpendicular to the axis of the trunnion. The trunnion is rotable on bearings carried on bearing supports on each side of the trunnion and a compresser mechanism including two braking jaws engage the disc from respective sides in braking contact therewith.

4 Claims, 2 Drawing Figures

DEVICE FOR ARRESTING A STEEL MAKING CONVERTER

FIELD AND BACKGROUND OF THE INVENTION

This invention relates in general to steel making equipment and in particular to a new and useful arresting device for a steel making converter.

While operating a converter, oscillations are produced during the blowing period, due to the reactions between the refining blast and the iron bath, which may adversely affect the gears of the attached drive transmission.

To prevent the transmission of bath oscillations to the converter drive, a prior art mechanism (German AS No. 25 54 912) provides an attached spur-gear transmission so as to eliminate the circumferential backlash. This is done with an additional motor.

With this prior art mechanism, converter vibrations cannot be entirely prevented from being transmitted to the gears of the drive transmission. In spite of the pinion pressed against the spur gear, a residual backlash remains between the gears.

SUMMARY OF THE INVENTION

The invention is directed to a mechanism that completely eliminates a transmission of forces produced by converter vibrations to the attached drive transmission, and which includes a braking mechanism including a compressor device to apply against a disc mounted on a converter trunnion.

In accordance with the invention the converter is mounted on a trunnion which includes trunnion parts extending to each side, each of which contains a disc which extends perpendicular to the axis of the trunnion and which are engaged by a compressive mechanism including jaws which engage the discs from each side.

Accordingly, it is an object of the invention to provide an improved device for arresting the pivotal movement of a trunnion of a converter which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
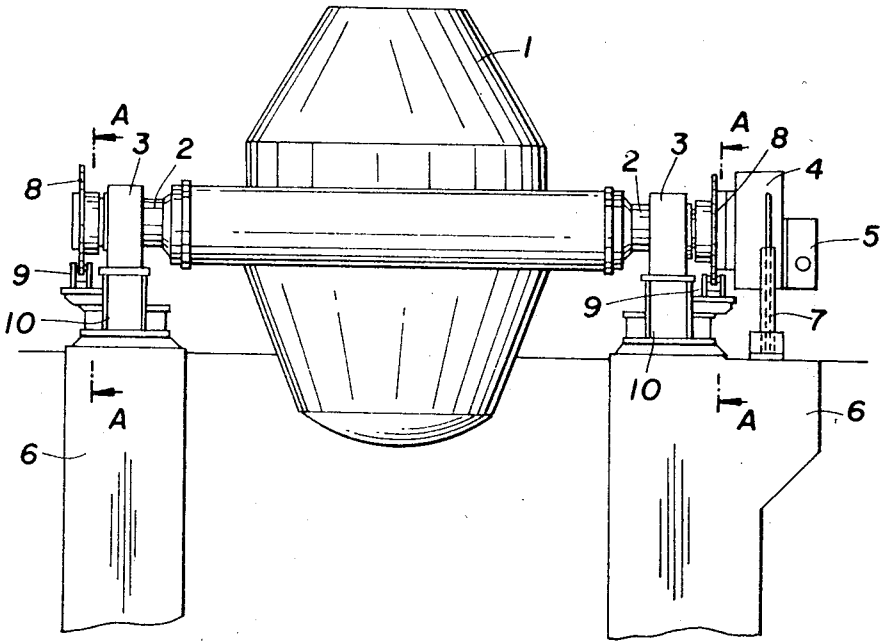
FIG. 1 is a side elevation showing a converter with its bearings and tilting drive.
Figure 2:
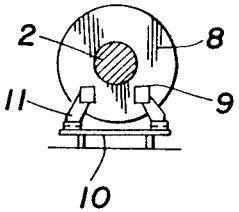
FIG. 2 is a sectional view taken along the line A—A of FIG. 1.

Referring to the drawings in particular the invention embodied therein comprises an arresting device for preventing a converter in service from moving itself during the blowing operation. The converter vessel 1 is supported by its trunnions 2 in bearings 3. One of the trunnions supports a drive transmission 4 with a motor 5, attached in overhung or cantilever position. The gear case of transmission 4 is supported on a foundation 6 through a torque bracket 7.

The trunnion 2 at the drive side carries a braking disc 8 against which two braking jaws 9 of a compressive mechanism 11 which is connected to the bearing support 10 or the foundation 6, can be pressed to arrest the trunnion. Jaws 9 can be brought to arresting contact with braking disc 8 hydraulically, pneumatically, or mechanically (not shown).

To obtain an as secure immobilization of the converter as possible, a braking disc 8 may in addition be provided on the other trunnion 2, at the opposite side, cooperating through braking jaws 9 with a compressive mechanism of its own.

Instead of full circular braking discs 8, disc segments or the like may be provided on the trunnions of the converter. In such an instance, projecting segment portions are provided at certain locations of the circumference, corresponding to the desired arresting positions, to be engaged by the compressive mechanism 11.

While a specific embodiment of the invention has been shown and described in detail to illustrate the application of the principles of the invention, it will be understood that the invention may be embodied otherwise without departing from such principles.

What is claimed is:

1. An arresting device for preventing a steel making converter from moving itself during a blowing operation comprising a converter having a trunnion which extends on each side of said converter, a braking disc connected directly to at least one of said trunnions and being disposed substantially perpendicular to the axis thereof, a fixed support for rotatably supporting said trunnion a pair of jaws disposed respectively on opposite sides of said disc, a compressive mechanism on said support, said jaws being connected to said compressive mechanism for movement together into braking contact with said disc, and drive means on said support connected to and for drivingly rotating of said trunnion located on one side of said converter, said compressive mechanism being located on said one side.

2. An arresting device according to claim 1, wherein the opposite trunnion on the opposite side of said converter from said drive means also has a braking disc and a separate compressive mechanism including jaws engageable from each side of said disc bearing against said disc.

3. An arresting device according to claim 2, wherein said drive means comprises a motor with transmission connected to an outer end of said trunnion on one side of said converter and spaced from said converter by a greater amount than said disc on one side of said converter, and a torque bracket fixed between said motor with transmission and said support.

4. An arresting device according to claim 3, including bearings fixed to said support and rotatably receiving said trunnions, each disc being connected to its trunnion on a side of said bearing opposite from said converter.

* * * * *